United States Patent [19]

Vernon et al.

[11] 4,345,989

[45] Aug. 24, 1982

[54] CATALYTIC HYDROGEN-DONOR LIQUEFACTION PROCESS

[75] Inventors: Lonnie W. Vernon, Baytown; Lavanga R. Veluswamy; Charles A. Euker, Jr., both of Houston, all of Tex.; Charles A. Mims, Summit, N.J.

[73] Assignee: Exxon Research & Engineering Co., Florham Park, N.J.

[21] Appl. No.: 181,602

[22] Filed: Aug. 27, 1980

[51] Int. Cl.[3] ..... C10G 1/06; B01J 37/00

[52] U.S. Cl. ..... 208/10; 252/425

[58] Field of Search ..... 208/10; 252/425

[56] References Cited

U.S. PATENT DOCUMENTS

| | | | |
|---|---|---|---|
| 1,981,614 | 11/1934 | Michot-Dupont | 208/10 X |
| 3,505,204 | 4/1970 | Hoffman | 208/10 |
| 3,642,607 | 2/1972 | Seitzer | 208/10 |
| 3,687,838 | 8/1972 | Seitzer | 208/10 |
| 3,715,303 | 2/1973 | Wennerberg et al. | 208/10 X |
| 3,796,650 | 3/1974 | Urban | 208/10 |
| 3,816,298 | 6/1974 | Aldridge | 208/112 |
| 3,920,536 | 11/1975 | Seitzer et al. | 208/10 |
| 4,011,153 | 3/1977 | Fu | 208/10 |
| 4,123,347 | 10/1978 | Maa | 208/8 LE |
| 4,222,849 | 9/1980 | Shimizu | 252/425 X |

FOREIGN PATENT DOCUMENTS

| | | | |
|---|---|---|---|
| 447930 | 5/1936 | United Kingdom | 208/10 |
| 2020691 | 11/1979 | United Kingdom . | |

*Primary Examiner*—Delbert E. Gantz
*Assistant Examiner*—William G. Wright
*Attorney, Agent, or Firm*—Yale S. Finkle

[57] ABSTRACT

Coal or a similar solid carbonaceous feed material is converted into lower molecular weight liquid hydrocarbons by contacting the feed material with a hydrogen-donor solvent containing above about 0.6 weight percent donatable hydrogen and molecular hydrogen in a liquefaction zone or a series of two or more liquefaction zones under liquefaction conditions in the presence of an added carbon-alkali metal catalyst comprising a carbon-alkali metal reaction product prepared by heating an intimate mixture of carbonaceous solids and an alkali metal constituent to a temperature above about 800° F. in a reaction zone external to the liquefaction zone.

21 Claims, 1 Drawing Figure

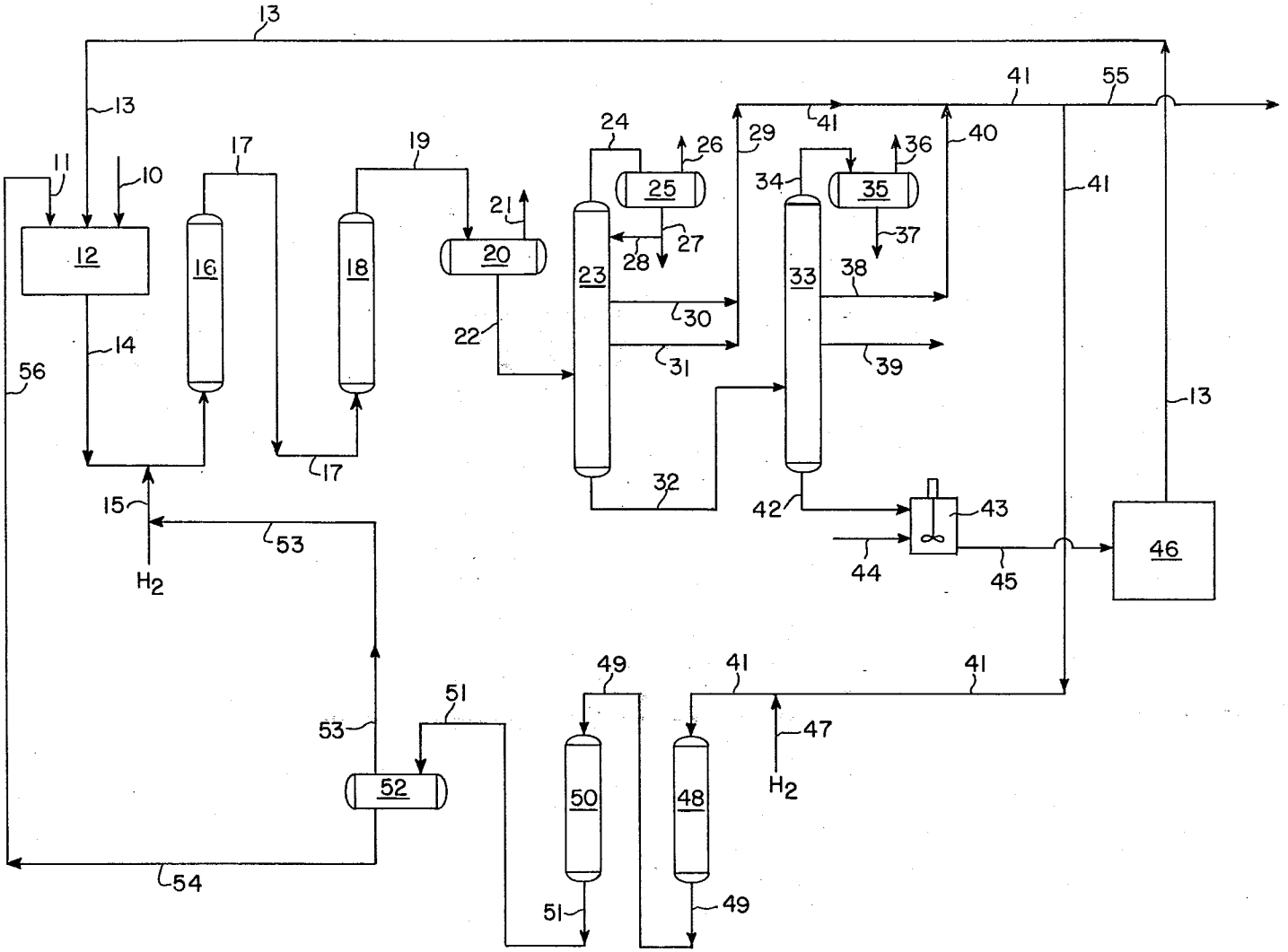
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
H2
H2

CATALYTIC HYDROGEN-DONOR LIQUEFACTION PROCESS

BACKGROUND OF THE INVENTION

This invention relates to coal liquefaction and is particularly concerned with catalytic hydrogen-donor coal liquefaction.

Processes for the direct liquefaction of coal and similar carbonaceous solids normally require contacting of the solid feed material with a hydrocarbon solvent and molecular hydrogen at elevated temperature and pressure to break down the complex high molecular weight starting material into lower molecular weight hydrocarbon liquids and gases. The most promising processes of this type are those carried out with a hydrogen-donor solvent which gives up hydrogen atoms in reaction with organic radicals liberated from coal or other feed material during the liquefaction step. In such a process, the hydrogen-donor solvent is subsequently regenerated in a downstream solvent hydrogenation step. Plants for carrying out processes of this type normally include facilities for generation of the needed molecular hydrogen by the gasification of heavy liquefaction bottoms produced in the liquefaction step, by the coking of liquefaction bottoms and subsequent gasification of the resultant coke, by the reforming of light hydrocarbon liquids and gases produced in the process, or by other means.

It has been suggested in the past that liquefaction processes can be improved by the use of hydrogenation catalysts in the liquefaction or reaction zone. Conventional hydrogenation catalysts that have been used for such purposes include cobalt-molybdenum, nickel-molybdenum and nickel-tungsten supported on alumina, silica-alumina and similar materials. Such hydrogenation catalysts have been used in both nondonor and hydrogen-donor solvent systems.

Although conventional hydrogenation catalysts of the type referred to above are reasonably effective in increasing yields from liquefaction processes, experience has shown that such materials are not well suited for use under liquefaction conditions because their activity is drastically decreased by the deposition of carbon and mineral matter on the surface and in the pores of the catalyst particles. Because of the deactivation caused by the severe temperature and pressure conditions extant in the liquefaction reactor, conventional hydrogenation catalysts are only effective for short periods of time and must be frequently replaced in order to maintain hydrogenation activity.

SUMMARY OF THE INVENTION

The present invention provides an improved process for converting coal or similar liquefiable solid carbonaceous feed material into lower molecular weight liquid hydrocarbons that at least in part avoids the difficulties referred to above. In accordance with the invention, it has now been found that high yields of liquid products can be obtained from bituminous coal, subbituminous coal, lignite or similar solid carbonaceous feed materials by contacting the feed material with a hydrogen-donor solvent containing above about 0.6 weight percent donatable hydrogen, preferably between about 1.2 and about 3.0 weight percent donatable hydrogen, and a hydrogen-containing gas, preferably molecular hydrogen, in a liquefaction zone under liquefaction conditions in the presence of an added carbon-alkali metal catalyst comprising a carbon-alkali metal reaction product prepared by heating an intimate mixture of carbonaceous solids and an alkali metal constituent to a temperature above about 800° F. in a reaction zone external to the liquefaction zone. The residence time of the catalyst and feed solids in the liquefaction zone will normally range between about 15 and about 120 minutes, preferably between about 30 minutes and about 90 minutes. Normally, the liquefaction zone is operated at a temperature between about 750° F. and about 900° F., and at a pressure between about 1000 psig and about 5000 psig, preferably between about 1500 and about 2500 psig. In normal operation the carbon-alkali metal catalyst is mixed with the feed material and passed through the liquefaction zone in plug flow so that all the catalyst that enters the zone exits the zone.

Experimental work has shown that carbon-alkali metal catalysts produced by heating an intimate mixture of coal, coke or similar carbonaceous solids with an alkali metal constituent exhibit a high hydrogenation activity and will increase the overall liquid yield from conventional hydrogen-donor liquefaction processes. Studies also indicate that such carbon-alkali metal catalysts resist poisoning by sulphur compounds during the liquefaction process, are resistant to catalyst degradation and are considerably less expensive than conventional hydrogenation catalysts used in the past. Preferably, the carbon-alkali metal catalyst is prepared by partially gasifying an intimate mixture of carbonaceous solids and an alkali metal constituent with steam. The hydrogen-donor solvent will normally be a recycle stream containing between about 1.2 and about 3.0 weight percent donatable hydrogen and produced by catalytically hydrogenating a portion of the liquids exiting the liquefaction zone in a hydrogenation zone external to the liquefaction zone.

In the preferred embodiment of the invention, the solid carbonaceous feed material is contacted with the hydrogen-donor solvent and the hydrogen-containing gas in the presence of the carbon-alkali metal catalyst during sequential residence in two or more liquefaction zones arranged in series and operated such that the temperature in each zone increases from the first to the final zone of the series and the total of the residence times in all except the final zone of the series is sufficient to produce an increase in liquid yield over that obtainable by single stage liquefaction carried out under the conditions in the final zone. The effluent from each liquefaction zone excluding the final zone is passed to the next succeeding zone of higher temperature. In this manner the feed solids that are not liquefied or converted into lower molecular weight liquids in the initial zone are at least partially liquefied in the second zone, the unconverted solids in the effluent from the second zone are at least partially liquefied in the third zone and so forth until the final zone is reached. Here the remaining unconverted solids are subjected to a relatively high temperature, preferably greater than 790° F., for maximum conversion of solids into lower molecular weight liquids. The effluent from the last liquefaction zone is then treated to recover liquid hydrocarbonaceous products. Normally, the total residence time for all the liquefaction zones combined excluding the final zone will be above about 30 minutes, preferably between about 40 and about 150 minutes. The temperature in the initial zone will normally be at least about 650° F., preferably between about 670° F. and about 750° F. As many liquefaction zones as are economically viable may be utilized. In the most preferred embodiment of the invention, however, only two zones are used. When this is the case, the temperature in the second zone is preferably between about 50° F. and 150° F. greater than the temperature in the first zone.

In the embodiments of the invention described above, a portion of the solid carbonaceous feed material will remain unconverted after passing through the liquefaction zone or zones and is normally further converted in order to utilize the remaining carbon and thereby provide further economies to the overall liquefaction process. The further conversion will normally be carried out by gasifying the liquefaction bottoms or by coking the liquefaction bottoms and subsequently gasifying the resultant coke. It is preferred that the carbon-alkali metal catalyst utilized in the liquefaction zone or zones be prepared in the bottoms conversion process by impregnating the liquefaction bottoms with an alkali metal constituent prior to subjecting the bottoms to further conversion. In this manner, the alkali metal constituents needed to form the carbon-alkali metal catalysts will also serve as a catalyst for the gasification required in converting the liquefaction bottoms. This, in turn, will add additional economies to the overall liquefaction process by allowing the liquefaction bottoms conversion to be carried out at lower temperatures in smaller equipment.

BRIEF DESCRIPTION OF THE DRAWING

The drawing is a schematic diagram of a catalytic staged temperature hydrogen-donor liquefaction process for producing liquid products from coal carried out in accordance with the invention.

DESCRIPTION OF THE PREFERRED EMBODIMENTS

In the process depicted in the drawing, coal or similar solid carbonaceous feed material is introduced into the system through line 10 from a coal storage or feed preparation zone, not shown in the drawing, and combined with a hydrogen-donor solvent introduced through line 11 and a carbon-alkali metal catalyst introduced through line 13 to form a slurry in slurry preparation zone 12. The feed material employed will normally consist of solid particles of bituminous coal, subbituminous coal, lignite, brown coal, or a mixture of two or more such materials. In lieu of coal, other solid carbonaceous materials may be introduced into the slurry preparation zone. Such materials include organic wastes, oil shale, liquefaction bottoms and the like. The particle size of the feed material may be on the order of about ¼ inch or larger along the major dimension but will preferably be crushed and screened to a particle size of about 8 mesh or smaller on the U.S. Sieve Series Scale. It is generally preferred to dry the feed particles to remove excess water, either by conventional techniques before the feed solids are mixed with the solvent in the slurry preparation zone or by mixing the wet solids with hot solvent at a temperature above the boiling point of water, preferably between about 250° F. and 350° F., to vaporize the water in the preparation zone. The moisture in the feed slurry is preferably reduced to less than about 2 weight percent.

The hydrogen-donor solvent used in preparing the slurry in preparation zone 12 will normally be a coal-derived solvent, preferably a hydrogenated recycle solvent containing at least 20 weight percent of compounds that are recognized as hydrogen donors at the elevated temperatures of about 700° F. to about 1000° F. generally employed in coal liquefaction reactors. Solvents containing at least 50 weight percent of such compounds are preferred. Representative compounds of this type include $C_{10}$–$C_{12}$ tetrahydronaphthalenes, $C_{12}$ and $C_{13}$ acenaphthenes, di, tetra- and octahydroanthracenes, tetrahydroacenaphthenes and other derivatives of partially hydrogenated aromatic compounds. Normally, the solvent will contain above about 0.6 weight percent donatable hydrogen, preferably between about 1.2 and about 3.0 weight percent. Such solvents have been described in the literature and will therefore be familiar to those skilled in the art. The solvent composition resulting from the hydrogenation of a recycle solvent fraction will depend in part upon the particular coal used as the feedstock to the process, the process steps and operating conditions employed, and the conditions used in hydrogenating the solvent fractions selected for recycle following liquefaction. In slurry preparation zone 12 the incoming feed coal is normally mixed with solvent recycled through line 11 in a solvent-to-coal weight ratio of from about 1:1 to about 4:1, preferably from about 1.2:1 to about 1.8:1.

The carbon-alkali metal catalyst injected into slurry preparation zone 12 through line 13 is prepared by heating an intimate mixture of carbonaceous solids and an alkali metal constituent to a temperature of about 800° F. or higher thereby forming a carbon-alkali metal reaction product. The heating step is carried out in a reaction zone external to the liquefaction reactors utilized in the process of the invention. Carbonaceous solids which may be employed in preparing the catalyst include coal, coal char, coke, charcoal, activated carbon, and the like. Preferably, the carbonaceous solids employed will be the liquefaction bottoms produced in the process of the invention as described in detail hereinafter. In some cases inorganic carriers having carbon deposited on their outer surface can also be used. Suitable carriers include silica, alumina, silica-alumina, naturally occurring zeolites, synthetic zeolites, spent cracking catalyst, and the like. The catalyst particles, whether composed substantially of carbon and an alkali metal constituent or made up of carbon and an alkali metal constituent deposited on an inert carrier, may range from fine powders to coarse lumps, particles between about 4 and about 100 mesh on the U.S. Sieve Series Scale generally being preferred.

Any of a variety of alkali metal constituents can be used in preparing the carbon-alkali metal catalyst. Suitable constituents include the alkali metals themselves and alkali metal compounds such as alkali metal carbonates, bicarbonates, formates, oxylates, hydroxides, sulfides, nitrates, and mixtures of these and other similar compounds. All of these are not equally effective and hence a catalyst prepared from certain alkali metal constituents can be expected to give somewhat better results under certain conditions than do others. In general, cesium, potassium, sodium and lithium salts derived from organic or inorganic acids having ionization constants less than about $1\times10^{-3}$ and alkali metal hydroxides are preferred. Because of their high activity, relatively low cost compared to cesium compounds, and ready availability, potassium compounds or sodium compounds are generally employed. Potassium carbonate and potassium hydroxide are especially effective.

Depending upon the particular material selected and the manner in which the process of the invention is to be carried out, the alkali metal constituent and carbonaceous solids can be combined to form an intimate mixture of the two in a variety of different ways. One procedure is to dissolve a water-soluble alkali metal salt or hydroxide in an aqueous carrier, impregnate the carbonaceous solids with the resulting aqueous solution by soaking or spraying the solution onto the particles, and thereafter drying the solids. In some cases the carbonaceous solids can be impregnated by suspending a finely divided alkali metal compound in a hydrocarbon solvent or other inert liquid carrier of suitably low viscosity and high volatility and thereafter treating the solids with the liquid containing the alkali metal constituent. In other instances, it may be advantageous to pelletilize a very finely divided alkali metal or alkali metal compound with carbon in an oil or similar binder and then heat the pellets to an elevated temperature. Other catalyst preparation methods, including simply mixing finely divided carbonaceous material with a powdered alkali metal salt and thereafter heating the mixture to the desired temperature, can in some cases also be used.

Normally, the carbon-alkali metal catalyst is prepared by combining the carbonaceous solids with from about 5 to about 50 weight percent of the alkali metal constituent, preferably from about 10 to about 30 weight percent. The optimum amount of the alkali metal constituent will depend in part upon the particular constituent and the preparation method selected. The particles containing carbon and the alkali metal constituents can be heated to temperatures sufficiently high to produce a reaction between the two in an external furnace or the like. It is, however, preferred to prepare the catalyst by reacting the carbonaceous solids and the alkali metal constituent with steam at a temperature in the range between about 1150° F. and about 1500° F. It has been found that catalysts prepared in this fashion are more effective, evidently because they have a higher surface area, than catalysts prepared by other methods. It is important that the carbon-alkali metal catalyst not be allowed to contact steam or oxygen at relatively low temperatures, temperatures below about 800° F., or the resultant oxidizing conditions will destroy the hydrogenation activity of the catalyst. In general, it is desirable to maintain the catalyst in a reducing atmosphere at all times after its preparation.

Referring again to the drawing, a sufficient amount of the carbon-alkali metal catalyst is injected into slurry feed preparation zone 12 to provide a catalyst-to-coal weight ratio of from about 0.05:1 to about 1:1, preferably from about 0.1:1 to about 0.25:1. The resultant coal-catalyst-solvent slurry is withdrawn from the preparation zone through line 14; mixed with a hydrogen-containing gas, preferably molecular hydrogen, injected into line 14 via line 15; preheated to a temperature above about 670° F.; injected into first stage liquefaction reactor 16; and passed upwardly through the reactor in plug flow. The mixture of the slurry and hydrogen-containing gas will contain from about 1 to about 8 weight percent, preferably from about 2 to about 5 weight percent, of hydrogen on a moisture-free coal basis. The liquefaction reactor is maintained at a temperature between about 670° F. and about 750° F., preferably between about 690° F. and about 720° F., and at a pressure between about 1000 psig and about 5000 psig, preferably between about 1500 psig and about 2500 psig. Although a single liquefaction reactor is shown in the drawing as comprising the first stage, a plurality of reactors arranged in parallel or series can also be used, providing that the temperature and pressure in each reactor remain approximately the same. Such will be the case if it is desirable to approximate a plug flow situation. Normally, a fluidized bed is not utilized in the reaction zone. The slurry residence time within the first stage reactor 16 will normally be above about 30 minutes and will preferably range from about 40 minutes to about 150 minutes.

Within the liquefaction zone in reactor 16, the coal undergoes liquefaction or chemical conversion into lower molecular weight constituents. The high molecular weight constituents of the coal are broken down and hydrogenated to form lower molecular weight gases and liquids. The hydrogen-donor solvent molecules react with organic radicals liberated from the coal to stabilize them and thereby prevent their recombination. The hydrogen injected into line 14 via line 15 also serves at least in part to stabilize organic radicals generated by the cracking of coal molecules. The carbon-alkali metal catalyst promotes the in situ hydrogenation of the donor solvent to convert aromatics into hydroaromatics thereby maintaining a relatively high concentration of donatable hydrogen in the solvent. This in turn results in an increased conversion of the feed coal into lower molecular weight liquids. The catalyst also promotes the direct hydrogenation of the coal structure and organic radicals generated by the cracking of coal molecules.

The effluent from first stage liquefaction reactor 16, which contains gaseous liquefaction products such as carbon monoxide, carbon dioxide, ammonia, hydrogen, hydrogen sulfide, methane, ethane, ethylene, propane, propylene, and the like; unreacted hydrogen from the feed slurry; light liquids; and heavier liquefaction products including mineral matter, unconverted coal solids, high molecular weight liquids and carbon-alkali metal catalyst is withdrawn from the top of the reactor through line 17, preheated and passed to the second stage liquefaction reactor 18. Here the effluent is subjected to further liquefaction at a temperature greater than the temperature in liquefaction reaction 16, normally at a temperature above about 790° F. and preferably at a temperature between about 830° F. and about 880° F. The pressure in the reactor will normally range between about 1000 psig and about 5000 psig, preferably between about 1500 psig and about 2500 psig. Although a single liquefaction reactor is shown in the drawing as comprising the second liquefaction stage, a plurality of reactors arranged in parallel or series can also be used providing that the temperature and pressure in each reactor remain about equal. Such will be the case if it is desirable to approximate a plug flow situation. Normally, a fluidized bed is not employed in the reaction zone. The slurry residence time within the second stage reactor 18 will normally range from about 15 minutes to about 120 minutes and will preferably be between about 40 minutes and about 80 minutes. Normally, the residence time in the first stage reactor 16 will be greater than the residence time in the second stage reactor 18.

The reactions taking place in the liquefaction zone in second stage reactor 18 are similar to those that occur in first stage liquefaction reactor 16. The unconverted coal and high molecular weight constituents are broken down and hydrogenated to form lower molecular weight gases and liquids. The hydrogen-donor solvent molecules react with organic radicals formed when the unconverted coal and high molecular weight constituents are cracked, thereby preventing their recombination. Molecular hydrogen in the gas phase also serves, at least in part, to stabilize organic radicals generated by the cracking of the coal and other high molecular weight constituents. The carbon-alkali metal catalyst promotes the in situ hydrogenation of the donor solvent to convert aromatics into hydroaromatics thereby maintaining a relatively high concentration of donatable hydrogen in the solvent. This in turn results in an increased conversion of the solid carbonaceous residue produced in reactor 16 into lower molecular weight liquids. The catalyst also promotes the direct hydrogenation of the coal structure and organic radicals generated by the cracking of unconverted coal molecules.

The process of the invention is based in part upon the discovery that the heating of an intimate mixture of carbonaceous solids and an alkali metal constituent, preferably by partial steam gasification, to a temperature above about 800° F. will result in the formation of a carbon-alkali metal reaction product that exhibits hydrogenation activity and when introduced into a liquefaction zone is effective in increasing the conversion of high molecular weight solid carbonaceous feed material into lower molecular weight liquids in the presence of a hydrogen-donor solvent and molecular hydrogen. This increase in conversion will occur if the liquefaction is carried out in a single liquefaction zone or in multiple liquefaction zones arranged in series and operated such that the temperature increases from the first to the last zone in the series. The mechanisms which take place as the result of impregnating or otherwise combining the carbonaceous solids with alkali metal constituents and heating the intimate mixture to temperatures above 800° F. are not fully understood. It is believed, however, that the alkali metal constituents react with carbon to form carbon-alkali metal compounds or complexes. Studies have shown that neither the carbonaceous solids nor the alkali metal compounds alone are effective hydrogenation or liquefaction catalysts and that high catalytic activity is obtained only when the carbon-alkali metal compounds or complexes are employed. Both constituents of the catalyst are therefore necessary.

Referring again to the drawing, the effluent from second stage reactor 18 is withdrawn from the top of the reactor through line 19 and passed to separator 20. Here the reactor effluent is separated, preferably at liquefaction pressure, into an overhead vapor stream which is withdrawn through line 21 and a liquid stream removed through line 22. The overhead vapor stream is passed to downstream units where the ammonia, hydrogen and acid gases are separated from the low molecular weight gaseous hydrocarbons, which are recovered as valuable byproducts. Some of these light hydrocarbons, such as methane and ethane, may be steam reformed to produce hydrogen that can be recycled where needed in the process.

The liquid stream removed from separator 20 through line 22 will normally contain low molecular weight liquids, high molecular weight liquids, mineral matter and unconverted coal. This stream is passed through line 22 into atmospheric distillation column 23 where the separation of low molecular weight liquids from the high molecular weight liquids boiling above 1000° F. and solids is begun. In the atmospheric distillation column, the feed is fractionated and an overhead fraction composed primarily of gases and naphtha constituents boiling up to about 350° F. is withdrawn through line 24, cooled and passed to distillate drum 25 where the gases are taken off overhead through line 26. This gas stream may be employed as a fuel gas for generation of process heat, steam reformed to produce hydrogen that may be recycled to the process where needed or used for other purposes. Liquids are withdrawn from distillate drum 25 through line 27 and a portion of the liquids may be returned as reflux through line 28 to the upper portion of the distillation column. The remaining naphtha is normally recovered as product.

One or more intermediate fractions boiling within the range from about 350° F. to about 700° F. is recovered from distillation column 23 as product or for use as feed to the solvent hydrogenation unit, which is described in detail hereafter. It is generally preferred to withdraw a relatively light fraction composed primarily of constituents boiling below about 500° F. through line 30 and to withdraw a heavier intermediate fraction composed primarily of constituents boiling below about 700° F. through line 31. These two distillate fractions are passed through line 29 into line 41. The bottoms from the distillation column, composed primarily of constituents boiling in excess of 700° F. is withdrawn through line 32, heated to a temperature between about 600° F. and 775° F., and introduced into vacuum distillation column 33.

In the vacuum distillation column, the feed is distilled under reduced pressure to permit the recovery of an overhead fraction that is withdrawn through line 34, cooled and passed into distillate drum 35. Gases are removed from the distillate drum via line 36 and may be either used as fuel, passed to a steam reformer to produce hydrogen for recycling to the process where needed, or used for other purposes. Light liquids are withdrawn from the distillate drum through line 37. A heavier intermediate fraction, composed primarily of constituents boiling below about 850° F., may be withdrawn from the vacuum distillation tower through line 38 and passed through line 40 into line 41. A still heavier side stream may be withdrawn through line 39 and recovered as product. The bottoms from the vacuum distillation column, which consists primarily of high molecular weight liquids boiling above 1000° F., mineral matter, carbon-alkali metal catalyst and unconverted coal, is withdrawn through line 42. This heavy liquefaction bottoms product contains a substantial amount of carbon and is normally further converted to recover liquids and/or gases. Although any of a variety of conversion processes may be used on the heavy liquefaction bottoms including partial oxidation, it is normally preferred to first pyrolyze the bottoms to produce coke and additional coal liquids and then steam gasify the resultant coke to produce valuable gases including hydrogen which can be used where needed in the overall liquefaction process. Such a conversion process is described in detail in U.S. Pat. Nos. 4,060,478 and 4,048,054, both of which are hereby incorporated by reference.

Since the heavy liquefaction bottoms produced in vacuum distillation tower 33 comprises suitable carbonaceous solids for the formation of the carbon-alkali metal catalyst required in liquefaction reactors 16 and 18, it is preferred to prepare the carbon-alkali metal catalyst by impregnating the liquefaction bottoms with an alkali metal constituent prior to subjecting the bottoms to the preferred conversion process. Since the bottoms conversion process is normally carried out at a temperature above 800° F., the carbon-alkali metal catalyst will be formed and at the same time the alkali metal constituents will serve to catalyze any gasification reactions taking place in the conversion process.

Referring again to the drawing, the liquefaction bottoms withdrawn from the vacuum distillation tower 33 through line 42 is passed to catalyst addition zone 43 where it is mixed with an alkali metal compound, preferably sodium or potassium carbonate or hydroxide, introduced into the catalyst addition zone through line 44. The resultant intimate mixture of liquefaction bottoms and alkali metal compound is then passed through line 45 to the bottoms conversion process designated by box 46 in the drawing. As previously mentioned, this conversion process will normally consist of pyrolyzing the intimate mixture of liquefaction bottoms and alkali metal compound, preferably in a fluidized bed coker, to produce liquids which can be recovered as product and to form coke with alkali metal constituents incorporated therein. The resultant coke is then passed to a fluidized bed gasifier where it is reacted with steam in the presence of an oxygen-containing gas. Under the conditions in the gasifier, the alkali metal compound reacts with the carbon present in the coke to form a carbon-alkali metal reaction product and at the same time serves to catalyze the reaction of steam with carbon thereby making it possible to lower the gasifier operating temperature and decrease its size. A portion of the alkali metal-containing char particles which comprise the fluidized bed in the gasifier is removed and passed through line 13 to slurry preparation zone 12 where it serves as the carbon-alkali metal catalyst in the liquefaction process. In some cases it may be desirable to use a portion of the alkali metal impregnated coke from the fluidized bed coker as the carbon-alkali metal catalyst in lieu of the alkali metal-containing char particles from the gasifier.

In the embodiment of the invention described above and shown in the drawing, the carbon-alkali metal catalyst is produced in the liquefaction bottoms conversion process by mixing an alkali metal compound with liquefaction bottoms, subjecting the mixture to pyrolysis in a coker and then gasifying the resultant coke. It will be understood that the carbon-alkali metal catalyst can be prepared in the bottoms conversion process in other alternative ways. In one such alternative, the alkali metal compound is not mixed with the liquefaction bottoms and is instead impregnated onto the coke produced by pyrolyzing the liquefaction bottoms. The impregnated coke is then gasified to produce the catalyst.

The liquid feed available for solvent hydrogenation includes liquid hydrocarbons composed primarily of constituents boiling in the 350° F. to 700° F. range recovered from atmospheric distillation column 23 through line 29 and heavier hydrocarbons in the 700° F. to 850° F. boiling range recovered from vacuum distillation column 33 through line 40. Only a portion of these potential hydrogenation reactor feed components, which are combined in line 41, are actually needed to produce the recycle solvent. The portion that is not needed for feed to the hydrogenation reactor is withdrawn as product through line 55. The remaining portion is heated to solvent hydrogenation temperature, mixed with hydrogen injected into line 41 through line 47 and introduced into the hydrogenation reactor. The particular reactor shown in the drawing is a two stage downflow unit including an initial stage 48 connected by line 49 to second stage 50, but other types of reactors can be used if desired.

The solvent hydrogenation reactor is preferably operated at about the same pressure as that in liquefaction reactor 18 and at a somewhat lower temperature. In general, temperatures within the range between about 550° F. and about 850° F., pressures between about 800 psig and 3000 psig, and space velocities between about 0.3 and 3.0 pounds of feed/hour/pound of hydrogenation catalyst are employed in the hydrogenation reactor. It is generally preferred to maintain a mean hydrogenation temperature within the reactor between about 620° F. and 750° F. Any of a variety of conventional hydrotreating catalysts may be employed in the reactor. Such catalysts typically comprise an inert support carrying one or more iron group metals and one or more metals from Group VI-B of the Periodic Table in the form of an oxide or sulfide. Combinations of one or more Group VI-B metal oxide or sulfide with one or more Group VIII metal oxide or sulfide are generally preferred. Representative metal combinations which may be employed in such catalysts include oxides and sulfides of cobalt-molydenum, nickel-molybdenum, and the like.

The hydrogenated effluent from the second stage 50 of the reactor is withdrawn through line 51 and passed into separator 52 from which an overhead stream containing hydrogen gas is withdrawn through line 53. This gas stream is at least partially recycled through line 53 for reinjection with the feed slurry into liquefaction reactor 16. Hydrogenated liquid hydrocarbons are withdrawn from the separator through line 54 and recycled through lines 56 and 11 for use as hydrogen-donor solvent in slurry preparation zone 12.

In the embodiment of the invention shown in the drawing and described above, the hydrogen-donor solvent is produced by hydrogenating coal derived liquids using conventional hydrotreating catalysts. In an alternative embodiment of the invention, the carbon-alkali metal catalyst used as a liquefaction catalyst in reactors 16 and 18 may also be used as a hydrogenation catalyst for hydrogenating the coal derived liquids. In this embodiment of the invention, fixed bed hydrogenation reactor stages 48 and 50 are replaced with one upflow reactor similar to reactors 16 and 18. The carbon-alkali metal catalyst in line 13 is not passed directly to slurry preparation zone 12 but is first mixed with the liquids in line 41. The mixture of liquids and catalyst is then passed upwardly through the single upflow reactor with the hydrogen gas injected through line 47. As the slurry passes through the reactor, the carbon-alkali metal catalyst promotes the hydrogenation of the liquids to produce the hydrogen-donor solvent. The effluent taken overhead from the reactor is passed to separator 52 where gaseous products are removed. The slurry of hydrogen-donor solvent and carbon-alkali metal catalyst is recovered from the separator through line 54 and passed through lines 56 and 11 to slurry preparation zone 12.

The nature and objects of the invention are further illustrated by the results of laboratory tests which indicate that the liquid yields obtained from the hydrogen-donor liquefaction of coal are increased when the liquefaction is carried out in the presence of an added carbon-alkali metal catalyst.

In the first series of tests, a 30 milliliter stainless steel tubing bomb was charged with 3 grams of −100 mesh Illinois No. 6 coal, 4.8 grams of tetralin, a hydrogen-donor solvent, and 4 weight percent molecular hydrogen based on the weight of the coal. The bomb was agitated at a 120 cycles per minute for 80 minutes in a fluidized sand bath heated to maintain the temperature in the tubing bomb at 700° F. After agitation for 80 minutes, the temperature in the tubing bomb was increased to 840° F. and the bomb agitated at that temperature for 40 minutes. After agitation the bomb was allowed to cool to room temperature, the volume of gases bled off overhead was measured and a slurry consisting of high molecular weight carbonaceous particles and mineral matter suspended in liquid hydrocarbons was recovered from the bomb. The slurry was washed by mixing it for five minutes with cyclohexane in an amount equal to twenty times its weight. The mixture was then centrifuged for fifteen minutes at a speed of 2000 rpm. The upper layer, which was rich in cyclohexane, was decanted and the remaining bottom layer was remixed with cyclohexane and washed again as described above. This wash procedure was performed a total of five times. The amount of solid residue from the bomb that did not dissolve in the cyclohexane was measured. The amount of gases and solids produced expressed as weight percent on dry coal were added together and the total was subtracted from 100 to yield a number representing the amount of hydrocarbon liquids and water in the effluent from the tubing bomb. For comparison purposes the above-described experiment was repeated with 0.45 grams of a carbon-alkali metal catalyst being added to the tubing bomb in addition to the coal, tetralin, and hydrogen. The carbon-alkali metal catalyst was prepared by wetting Illinois No. 6 coal with an aqueous solution of potassium carbonate. The wet impregnated coal was then dried and partially gasified with steam at 1300° F. The results of these tests are set forth below as runs 1 and 2 in Table I.

In the second series of tests, two runs were conducted in exactly the same manner as the two runs described in the first series of tests except that a multipass spent solvent containing 1.51 weight percent donatable hydrogen was used in both runs as the hydrogen-donor solvent instead of tetralin. The results of these tests are set forth as runs 3 and 4 in Table I below.

TABLE I

EFFECT OF CARBON-ALKALI METAL CATALYST ON LIQUID YIELDS

| Run Number | 1 | 2 | 3 | 4 |
|---|---|---|---|---|
| First Stage Temp., (°F.) | 700 | 700 | 700 | 700 |
| First Stage Residence Time, (Minutes) | 80 | 80 | 80 | 80 |
| Second Stage Temp., (°F.) | 840 | 840 | 840 | 840 |
| Second Stage Residence Time, (Minutes) | 40 | 40 | 40 | 40 |
| Amount of Carbon-Alkali Metal Catalyst(Wt. % Dry Coal) | None | 15 | None | 15 |
| Donatable Hydrogen Concentration of Solvent, (Wt. % Solvent) | 3.0 | 3.0 | 1.5 | 1.5 |
| Yields, Wt. % Dry Coal | | | | |
| Gas | 7.3 | 7.0 | 9.2 | 9.7 |
| Solid Residue | 44.4 | 40.0 | 50.7 | 47.6 |
| Liquids* | 48.3 | 53.0 | 40.1 | 42.7 |

*Includes hydrocarbons and about 6 wt. % water based on dry coal.

As can be seen from runs 1 and 2 in Table I, the carbon-alkali metal catalyst increased the liquid yield about 4.7% weight percent in a staged temperature liquefaction operation utilizing tetralin as the hydrogen-donor solvent. Tetralin has a donatable hydrogen concentration of about 3.0 weight percent and is therefore an extremely good hydrogen-donor solvent. Runs 3 and 4 indicate that the carbon-alkali metal catalyst will increase liquid yields in staged temperature operations with a hydrogen-donor solvent of poorer quality than tetralin. The liquid yield in run 4 was about 2.6 weight percent greater than the yield in run 3, which was carried out in the absence of the catalyst.

It will be apparent from the preceding discussion that the invention provides an improved process for converting coal and similar solid carbonaceous feed materials into liquid product. The process encompasses the efficient use of a carbon-alkali metal hydrogenation catalyst to increase the yield of liquid product with a resultant decrease in the amount of high molecular weight bottoms that is produced.

We claim:

1. A catalytic hydrogen-donor liquefaction process for converting a solid carbonaceous feed material into lower molecular weight liquid hydrocarbons which comprises contacting said feed material with a hydrogen-donor solvent containing above about 0.6 weight percent donatable hydrogen and a hydrogen-containing gas in a liquefaction zone under liquefaction conditions in the presence of an added carbon-alkali metal catalyst comprising a carbon-alkali metal reaction product prepared by partially gasifying an intimate mixture of carbonaceous solids and an alkali metal constituent with steam in a reaction zone external to said liquefaction zone.

2. A process as defined in claim 1 wherein said solid carbonaceous feed material comprises coal.

3. A process as defined in claim 1 wherein said intimate mixture of carbonaceous solids and alkali metal constituent is prepared by impregnating said carbonaceous solids with an aqueous solution of said alkali metal constituent.

4. A process as defined in claim 1 wherein the pressure in said liquefaction zone is maintained between about 1500 psig and about 2500 psig.

5. A process as defined in claim 1 including the additional steps of withdrawing a liquefaction effluent including constituents boiling in excess of about 1000° F. from said liquefaction zone; recovering a heavy liquefaction bottoms fraction containing said constituents boiling above 1000° F. from said liquefaction effluent; adding an alkali metal compound to said bottoms fraction to form an intimate mixture of said bottoms and said alkali metal compound; pyrolyzing said intimate mixture of said bottoms and said alkali metal compound to produce coke; gasifying said coke in the presence of steam; and using a portion of the gasified coke in said liquefaction zone as said carbon-alkali metal catalyst.

6. A process as defined in claim 5 wherein said alkali metal compound comprises potassium carbonate or potassium hydroxide.

7. A process as defined in claim 1 wherein said hydrogen-containing gas comprises molecular hydrogen.

8. A process as defined in claim 1 wherein said hydrogen-donor solvent comprises a recycle stream containing between about 1.2 and about 3.0 weight percent donatable hydrogen, said recycle stream produced by catalytically hydrogenating a portion of the liquids from said liquefaction zone in a hydrogenation zone external to said liquefaction zone.

9. A process as defined in claim 1 wherein said alkali metal constituent comprises potassium hydroxide or potassium carbonate.

10. A process as defined in claim 1 wherein said partial gasification takes place at a temperature between about 1150° F. and about 1500° F.

11. A catalytic hydrogen-donor liquefaction process for converting a solid carbonaceous feed material into lower molecular weight liquid hydrocarbons which comprises:

(a) contacting said carbonaceous feed material with a hydrogen-donor solvent and a hydrogen-containing gas under liquefaction conditions in the presence of an added carbon-alkali metal catalyst during sequential residence in two or more liquefaction zones arranged in series and operated such that (i) the temperature in each zone increases from the first to the final zone of the series and (ii) the total of the residence times in all except the final zone of the series is sufficient to produce an increase in liquid yield over that obtainable in single stage liquefaction carried out under the conditions in said final zone, wherein said carbonaceous feed material is partially converted into lower molecular weight liquid hydrocarbons in each of said liquefaction zones and said added carbon-alkali metal catalyst comprises a carbon-alkali metal reaction product prepared by partially gasifying an intimate mixture of carbonaceous solids and an alkali metal constituent with steam in a reaction zone external to said liquefaction zone; and (b) recovering liquid hydrocarbonaceous product from the effluent of said final liquefaction zone.

12. A process as defined in claim 11 wherein said hydrogen-containing gas comprises molecular hydrogen.

13. A process as defined in claim 11 wherein the total of the residence times in all except said final liquefaction zone is between about 40 and about 150 minutes.

14. A process as defined in claim 11 wherein said first liquefaction zone is operated at a temperature above about 650° F.

15. A process as defined in claim 11 wherein two liquefaction zones are employed in step (a).

16. A process as defined in claim 11 wherein said carbonaceous solids comprise coal.

17. A process as defined in claim 11 including the additional steps of recovering a heavy liquefaction bottoms fraction containing constituents boiling in excess of about 1000° F. from the effluent of said final liquefaction zone; adding an alkali metal compound to said bottoms fraction to form an intimate mixture of said bottoms and said alkali metal compound; pyrolyzing said intimate mixture of said bottoms and said alkali metal compound to produce coke; gasifying said coke in the presence of steam; and using said gasified coke in each liquefaction zone in said series of liquefaction zones as said carbon-alkali metal catalyst.

18. A process as defined in claim 15 wherein the temperature in said first liquefaction zone is between about 670° F. and about 750° F. and the temperature in the second liquefaction zone is between about 830° F. and about 880° F.

19. A process as defined in claim 15 wherein the residence time in said first liquefaction zone is between about 40 and about 150 minutes and the residence time in the second liquefaction zone is between about 15 and about 120 minutes.

20. A process as defined in claim 11 wherein said carbonaceous feed material comprises coal.

21. A process as defined in claim 11 wherein said partial gasification takes place at a temperature between about 1150° F. and about 1500° F.

* * * * *